US008967243B2

(12) United States Patent
Reaux

(10) Patent No.: US 8,967,243 B2
(45) Date of Patent: Mar. 3, 2015

(54) KICKOVER TOOL WITH RATCHETING ARM AND METHODS OF USE

(76) Inventor: James Reaux, Brookshire, TX (US)

( * ) Notice: Subject to any disclaimer, the term of this patent is extended or adjusted under 35 U.S.C. 154(b) by 410 days.

(21) Appl. No.: 13/374,677

(22) Filed: Jan. 6, 2012

(65) Prior Publication Data

US 2013/0175049 A1 Jul. 11, 2013

(51) Int. Cl.
*E21B 23/03* (2006.01)

(52) U.S. Cl.
USPC ..... 166/117.5

(58) Field of Classification Search
USPC ..... 166/378, 381, 117.5, 117.6
See application file for complete search history.

(56) References Cited

U.S. PATENT DOCUMENTS

| | | | | |
|---|---|---|---|---|
| 3,732,928 | A * | 5/1973 | Sizer | 166/383 |
| 3,788,397 | A * | 1/1974 | Terral et al. | 166/117.5 |
| 3,796,259 | A | 3/1974 | Outhouse | |
| 3,827,490 | A * | 8/1974 | Moore et al. | 166/117.5 |
| 3,874,445 | A * | 4/1975 | Terral | 166/117.5 |
| 3,889,748 | A * | 6/1975 | Tausch | 166/117.5 |
| 4,002,203 | A | 1/1977 | Terral | |
| 4,031,954 | A | 6/1977 | Herbert et al. | |
| 4,039,026 | A | 8/1977 | Yonker | |
| 4,051,895 | A | 10/1977 | Embree | |
| 4,067,350 | A | 1/1978 | Raggio | |
| 4,074,762 | A * | 2/1978 | Parker et al. | 166/385 |
| 4,146,091 | A * | 3/1979 | Terral | 166/117.5 |
| 4,294,313 | A | 10/1981 | Schwegman | |
| 4,368,780 | A | 1/1983 | Merritt | |
| 4,375,237 | A | 3/1983 | Churchman | |
| 4,452,305 | A | 6/1984 | Schwendemann | |
| 4,508,165 | A | 4/1985 | Foust | |
| 4,744,415 | A | 5/1988 | Crawford et al. | |
| 4,765,403 | A * | 8/1988 | Crawford et al. | 166/117.5 |
| 4,976,314 | A | 12/1990 | Crawford et al. | |
| 6,422,312 | B1 * | 7/2002 | Delatorre et al. | 166/250.15 |
| 6,845,817 | B2 | 1/2005 | Schraub | |
| 7,559,358 | B2 * | 7/2009 | DiFoggio et al. | 166/66.6 |
| 2007/0267200 | A1 | 11/2007 | Jackson et al. | |

* cited by examiner

*Primary Examiner* — Robert E Fuller

(57) ABSTRACT

A kickover tool having a ratcheting mechanism comprising a ratchet arm and a ratchet track. The ratchet arm is pivotally attached to an arm assembly and the ratchet track is attached to a surface of the main body. A method for operating the kickover tool apparatus can include the tool being able to traverse a tubing string and place or retrieve a tool or object from a side pocket mandrel. A string of two or more kickover tool apparatuses can be used to retrieve and/or place two or more separate tools or objects in one or more side pocket mandrels during a single trip operation. The kickover tool can function without placing any side loads on the side pocket device during the placing or retrieving procedure, thereby preventing any bending or fracturing of the side pocket device.

18 Claims, 8 Drawing Sheets

KICKOVER TOOL WITH RATCHETING ARM AND METHODS OF USE

BACKGROUND OF DISCLOSURE

1. Field of the Disclosure

Embodiments disclosed herein generally relate to apparatuses and methods for kickover tools for use in well bores, such as for example, during work over procedures. More specifically, embodiments disclosed herein relate to a ratcheting mechanism for an improved kickover tool apparatus and method of using the same. The disclosed embodiments provide an apparatus and method of use for placing and retrieving of any side pocket device without placing any side loads on the side pocket device during the placing or retrieving procedure, thereby preventing any bending or fracturing of the side pocket device. The disclosed embodiments further enable an apparatus and method of use for placing and/or retrieving a device from a multiple-pocket side pocket mandrel, i.e. one side pocket mandrel with more than one pocket; the number of pockets requires twice the number of kickover tools to service the mandrel.

2. Background Art

Kickover tools have been well known in the art since the 1970s for use in work over procedures in well bores. Generally, kickover tools operate by traversing the tubing of a well bore until a predetermined operational location is reached. A collar will have been previously inserted into the tubing for orienting the kickover tool into the proper operational position for interaction with a side pocket. As the kickover tool traverses the preinstalled collar, the kickover tool will rotate into the proper position for operations in the tubing of the well bore. Once oriented in the proper position, the kickover tool will open into a side pocket to complete its operation within the tubing of the well bore. The general kickover tool will then be collapsed from its open position to a closed position for retrieval from the tubing of the well bore.

Kickover tool arms may be open or extended automatically through the use of springs, hydraulics, and pneumatics among other forms known in the art, or kickover tools may be operated manually through wire line, electrical line, pneumatics, hydraulics, radio signals or other forms known in the art.

Known previous kickover tools tend to cause the bending of latches when the kickover tool is pulled out of a side pocket. As a result, there is a long felt need for a kickover tool that can readily be retrieved without having to replace or repair the tool.

SUMMARY OF DISCLOSURE

Embodiments disclosed herein provide a kickover tool having a ratcheting mechanism comprising a ratchet arm and a ratchet track. The ratchet arm is pivotally attached to an arm assembly and engages the ratchet track attached to a surface of the main body.

Other embodiments of the disclosure may provide a method for operating the kickover tool apparatus, as disclosed herein, the tool being able to traverse a tubing string and place or retrieve a tool or object from a side pocket mandrel.

Further methods include a string of two kickover tool apparatuses, as disclosed herein, to retrieve and place two separate tools or objects in a single side pocket mandrel in a single trip operation. The method allows for a placement or retrieval of a first tool or object from a single side pocket mandrel and a retrieval or placement of a second tool or object into the same side pocket mandrel.

Yet other methods using the kickover tool apparatus, as disclosed herein, allows for the retrieval or placement of multiple tools or objects from or into multiple side pocket mandrels.

Other aspects and advantages of the disclosure will be apparent from the following description and the appended claims.

DETAILED DESCRIPTION

Figure 1:
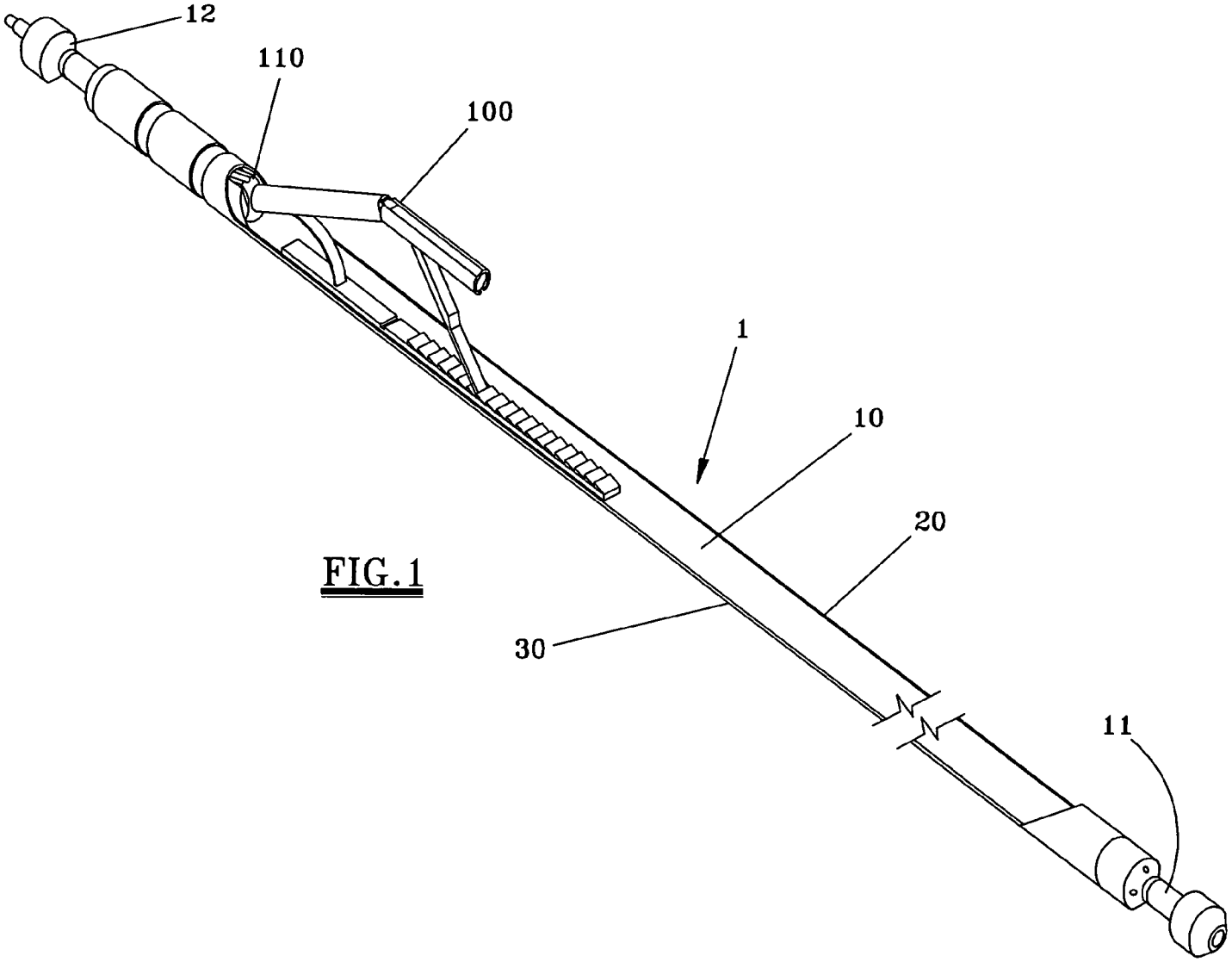
FIG. 1 shows an isometric representation of a kickover tool in accordance with embodiments of the present disclosure.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

Referring now to FIG. 1, a kickover tool apparatus 1 according to embodiments of the present disclosure, is shown. The kickover tool apparatus has a main body housing 10 with a first end 11 and a second end 12. The main body housing is substantially cylindrical in shape so as to accommodate insertion into and operations within a tubing string. In an embodiment of the kickover tool apparatus the main body housing has an internal surface 20 and an external surface 30. The internal surface is formed as a recess in the main body housing. Other embodiments may use a generally cylindrical housing and remove a portion of the housing to create a window, which would provide an internal surface 20 and external surface 30 of the main body housing 10.

The first end 11 of the main body housing 10 may include interchangeable fixtures so as to allow other tools to be affixed to the first end of the main body housing of the kickover tool apparatus. It should be appreciated that additional tools, as known in the art, may be interchanged to the first end 11 of the main body housing 10, so as to facilitate additional well operations.

The second end 12 of the main body housing 10 may include interchangeable fixtures so as to allow the attachment of mechanical wireline ("slickline"), electric line, well-tractor, or coil-tubing to the kickover tool apparatus to allow for insertion, operation, and retrieval of the kickover tool into, in, and from the tubing string, respectively.

The arm assembly 100 is attached to the main body housing 10 through a pivotal joint 110. The arm assembly of an embodiment, as depicted in FIG. 1, is shown in the extended position. The arm assembly is further capable of a retracted position wherein the arm assembly is substantially situated within and against the interior surface 20 of the main body housing 10. The length of the main body housing 10 and the inner surface 20 should be of sufficient length to allow the arm assembly to move into a retracted position with an attached object or tool.

Figure 2:
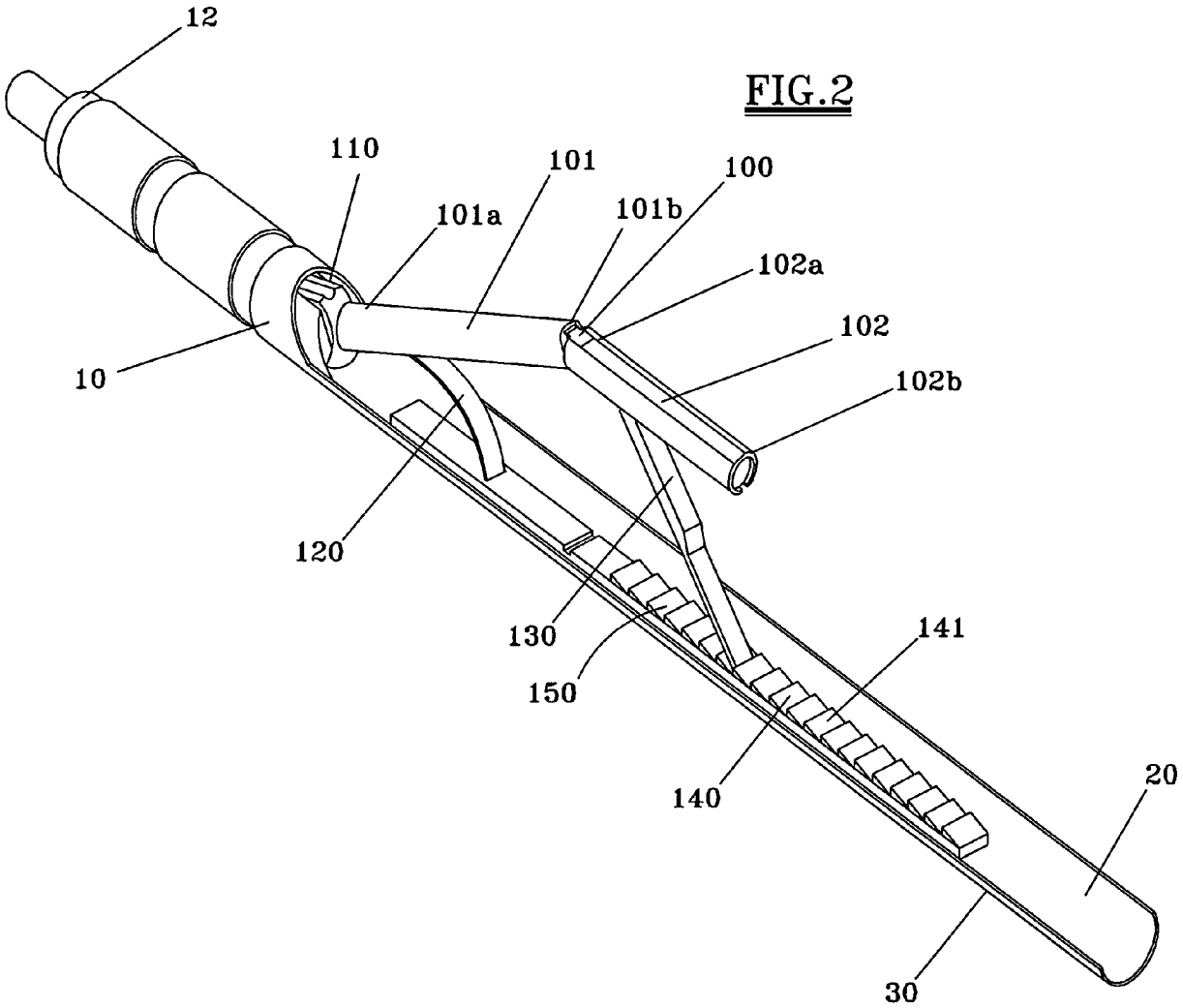
FIG. 2 shows an isometric close-up view of an arm assembly of a kickover tool in accordance with embodiments of the present disclosure.

Referring now to FIG. 2, an arm assembly 100 is shown in further detail. The arm assembly 100 of the embodiment depicted in FIG. 2 includes a first arm member 101 and a second arm member 102 each having a first end (101*a* and 102*a*, respectively) and a second end (101*b* and 102*b*, respectively). The first end 101*a* of the first arm member 101 is attached via a pin (not shown) to pivotal joint 110, which attaches the arm assembly to the main body housing 10. The second end 101*b* of the first arm member is formed to connect pivotally to the first end 102*a* of the second arm member 102 via a pin (not shown). In some embodiments, the second end 102*b* of the second arm member 102 is fitted with a device capable of receiving or accepting tools for placement or retrieval in a side pocket mandrel. In other embodiments, the second end 102*b* of the second arm member 102 is formed with a cavity capable of receiving or accepting tools for placement or retrieval of objects or tools in a side pocket mandrel.

The arm assembly 100 of the described embodiments can further include an attached spring 120 so as to bias the arm assembly outwards. The spring can be of different forms such as a leaf spring or coil spring. Other embodiments can further include hydraulic or pneumatic actuation members in place of the spring 120. The spring 120 has two ends; the first end is operatively connected to either the first arm member 101 or the second arm member 102 of the arm assembly 100. The second end of the spring is operatively attached or secured on the inner surface 20 of the main body housing 10.

The arm assembly 100 of the described embodiments can further include a ratcheting arm 130 pivotally attached to the arm assembly 100 either via the first arm member 101 or the second arm member 102. The ratcheting arm 130 of the described embodiments is capable of folding inwards towards the arm assembly 100 when the arm assembly 100 is in a retracted position. The ratcheting arm 130 pivots away from the arm assembly 100 when the arm assembly 100 is in the extended position and orients in a direction substantially towards the inner surface 20 of main body housing 10. The described embodiments can also further include a ratchet track 140 with a plurality of teeth 141 formed on a surface of the ratchet track 140. The ratchet track 140 is further secured to the inner surface 20 of the main body housing 10 wherein the surface formed with a plurality of teeth 141 is facing away from the inner surface 20 and facing towards the arm assembly 100. Further embodiments can include one or more shear pins 150 to secure or attach the ratchet track 140 to the inner surface 20 of the main body housing 10. The one or more shear pins 150 can be made of various materials, as known in the art, with different materials having different load bearing capabilities. As the arm assembly 100 moves or is actuated from the retracted position to the extended position, the ratchet arm 130 pivotally moves away from the first arm member 101 or the second arm member 102, depending on the particular embodiment, and engages the plurality of teeth 141 of the ratchet track 140. Once the arm assembly 100 is in an extended position, the ratchet arm 130 is securely engaged against the plurality of teeth 141 of the ratchet track 140. With the arm assembly 100 in the extended position, the kickover tool can place or retrieve tools in a side pocket mandrel via the second end 102*b* of the second arm member 102. Once a tool has been placed or retrieved by the second end 102*b* of the second arm member 102, the kickover tool apparatus 1 can then have a motive force exerted thereupon causing the kickover tool to traverse the tubing string towards the wellbore. This motive force exerted upon the kickover tool apparatus 1 causes the arm assembly 100 to contact the wall of the side pocket mandrel, which then exerts a force which causes the shear pin 150 to shear allowing the ratchet track 140 to move and thus disengage the ratchet arm 130 from the ratchet track 140, which allows the arm assembly 100 to collapse into a retracted position, which further allows retrieval of the kickover tool apparatus 1 from the tubing string. The force required to shear the shear pin 150 can be varied by use of various compositions of materials or sizes of shear pins, as is known in the art.

The several embodiments of the present disclosure provide an apparatus and method of use for placing and retrieving of any side pocket device without placing any side loads on the side pocket device during the placing or retrieving procedure, thereby preventing any bending or fracturing of the side pocket device.

The several embodiments of the present disclosure may also incorporate the use of including a sensor within the kickover tool, within the arm assembly, or attached to the arm assembly for identification of devices or tools located in a side pocket. Such sensors may be radio frequency technology such as RFID tags and readers or radioactive sensors.

Figure 3A:
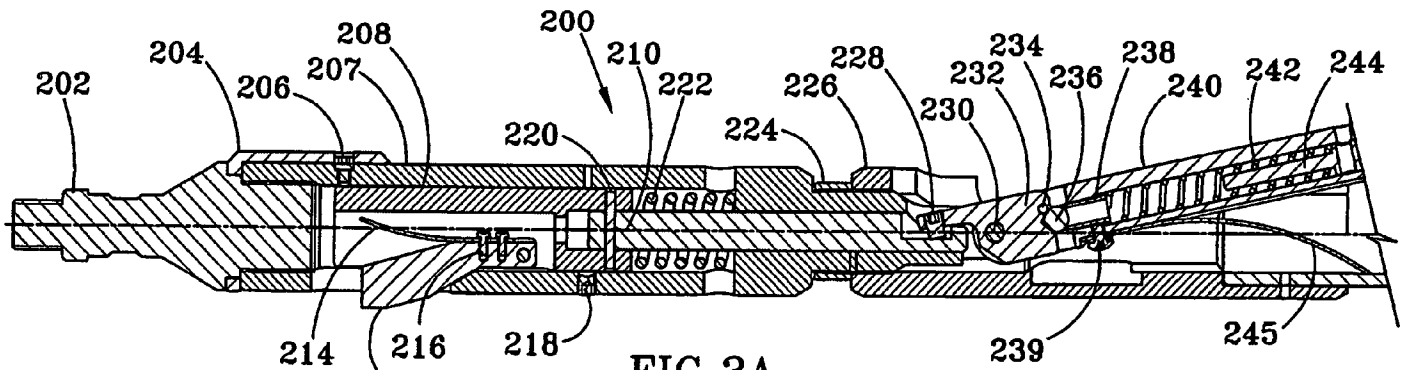
FIGS. 3A, 3B, and 3C illustrate a cut-away detailed side view of an embodiment of a kickover tool in accordance with embodiments of the present disclosure.
Figure 3B:
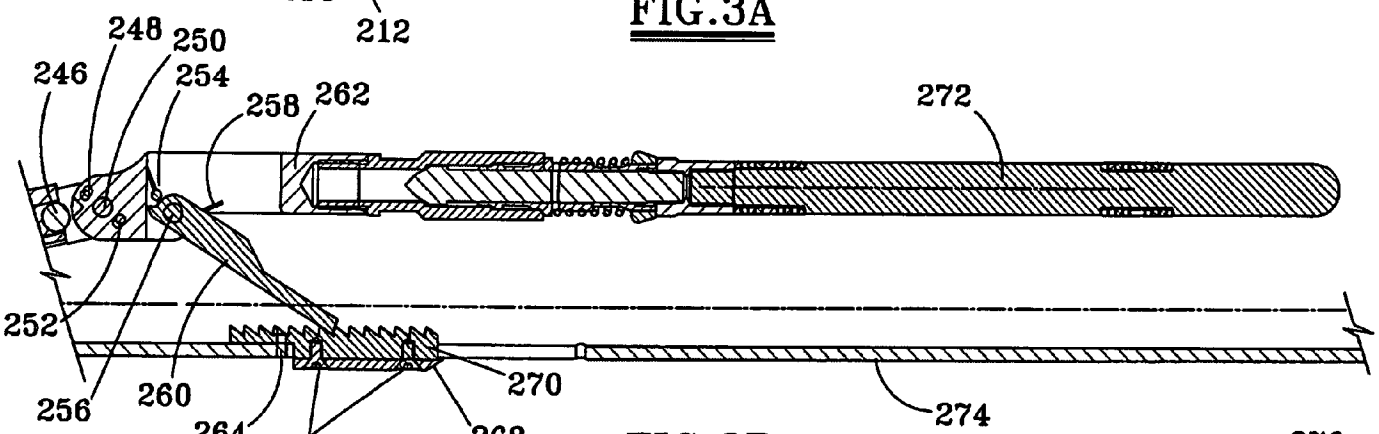
Figure 3C:
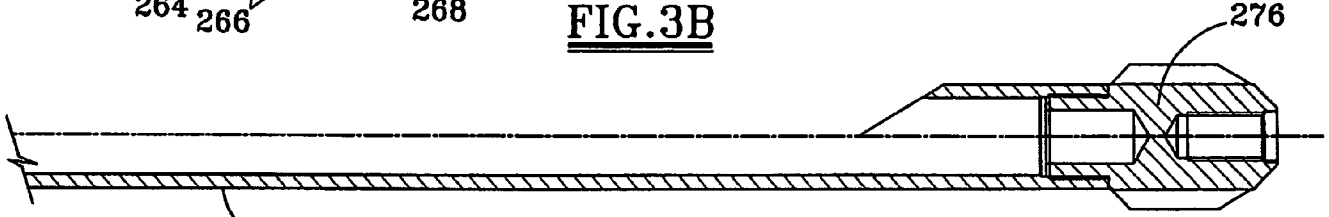

FIGS. 3A, 3B, and 3C illustrate another embodiment of the kickover tool 200. At a remote end of FIG. 3A is the fish neck 202. Adjacent the fish neck 202 is a centralizer sleeve 204, which is held in place by a screw 206. Engaged with the centralizer sleeve 204 is a finger cage 207. Internal of the finger cage 207 is a housing 208. Also engaged with the housing 208 is a locator finger 212 controlled by a leaf spring 214 and screws 216.

A release plunger pin 220 is engaged with a plunger 210. The housing 208 is secured with the setscrew 218.

A spring 222 engages the central portion of the kickover tool 200. A lock ring 224 is in association with an adapter 226. A lower arm pin 230 affixes an arm adapter 232 to an arm 240. A screw 228 secures the arm adapter 232, which is further in operation with a dowel pin 234, a ball 236, and an insert 238. Also associated with the arm 240 is a spring 242 and a ball seat 244. Further, a kick spring 245 is secured to the arm 240 using a screw 239.

Referring to FIG. 3B, a central portion of the kickover tool 200 is provided. In operative cooperation is a ball 246, an upper shear pin 248, an upper arm pin 250, a dowel pin 252, a ratchet arm pin 256, ratchet shear pin 254, and a ratchet arm 260. A torsion spring 258 is provided in association with the ratchet arm 260. Adjacent thereto is an adapter 262, which is an association with an assembly arm 272.

Also in FIG. 3B is the ratchet track 270. The ratchet track 270 is removably affixed to the housing 274. Also, the ratchet track 270 is in association with a ratchet track holder 268, a ratchet track shear pin 264, and screws 266.

FIG. 3C illustrates the remote end of the kickover tool 200 as illustrated in FIGS. 3A and 3B. A housing 274 is in association with the nose 276.

Figure 4A:
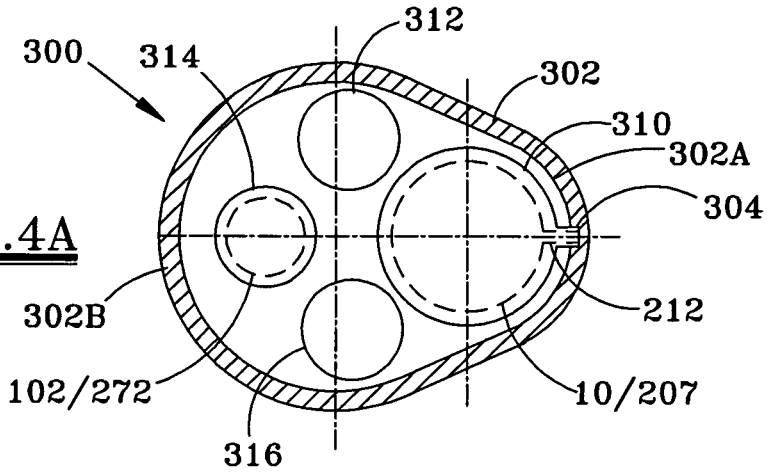
FIGS. 4A, 4B, and 4C illustrate a top cut away view of an embodiment of the kickover tool in accordance with embodiments of the present disclosure.

FIG. 4A illustrates a top down point of view of an embodiment of the kickover tool within a tubular 300 having side pockets 312, 314, and 316. The tubular 300 has a wall 302 with an outer surface 302B and inner surface 302A. The embodiment depicted in FIG. 4A includes the main body housing 10 and finger cage 207 traveling through tubing 310 in substantial proximity to side pockets 312, 314, and 316. The embodiment further includes a locator finger 212 being received by notch 304 on the inner surface 302A of the tubular wall 302 to allow for orientation of the kickover tool. The second arm member 102 and assembly arm 272 are depicted in an extended position and being in substantial alignment with side pocket 314.

Figure 4B:
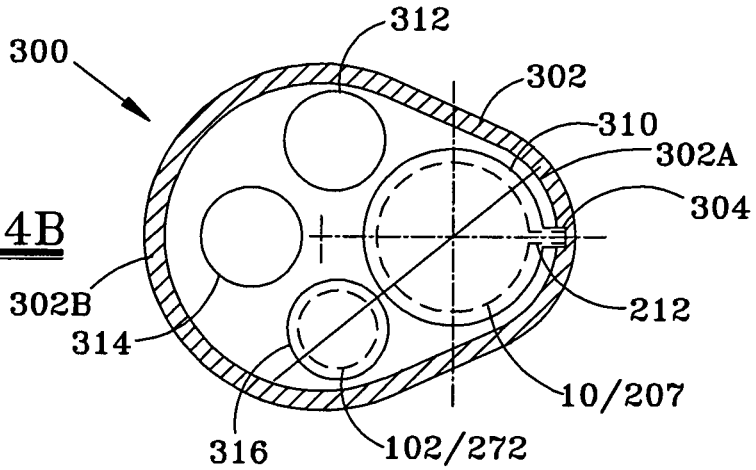

FIG. 4B depicts another top down point of view of an embodiment of the kickover tool; this embodiment is similar to that of FIG. 4A, but this embodiment depicts the second arm member 102 and assembly arm 272 in the extended position and 45 degrees off-center to the left and in substantial alignment with side pocket 316. The locator finger 212 is still engaged with notch 304 to provide for alignment of the main body housing 10.

Figure 4C:
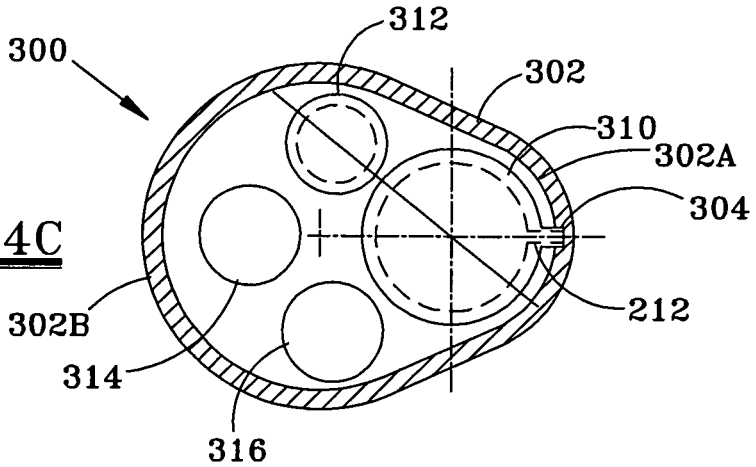

FIG. 4C is yet another depiction of an embodiment of the kickover tool; this embodiment is similar to that of FIGS. 4A and 4B, but this particular embodiment depicts the second arm member 102 and assembly arm 272 in the extended position and 45 degrees off-center to the right and in substantial alignment with side pocket 312. The locator finger 212 is still engaged with notch 304 to provide for alignment of the main body housing 10.

Figure 5A:
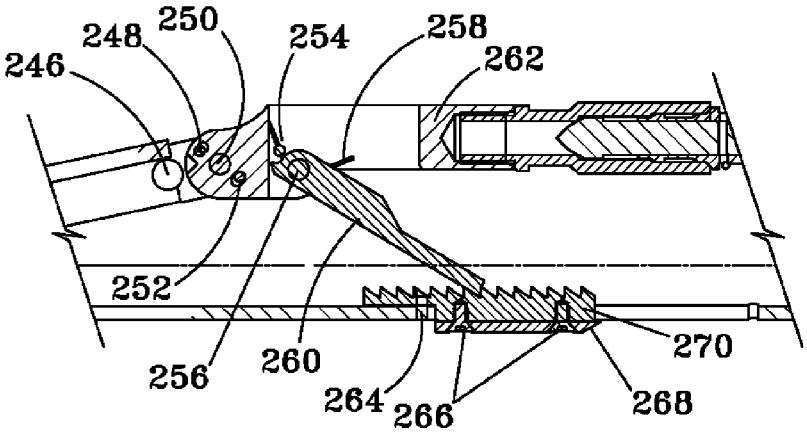
FIGS. 5A, 5B, and 5C illustrate a cut-away detailed side view of an embodiment of a kickover tool in accordance with embodiments of the present disclosure and particularly various embodiments for locking the arm in an extended position.

FIG. 5A illustrates a close up view of the central portion of the kickover tool 200, as depicted in FIG. 3B. The embodiment depicted in FIG. 5A includes a ratchet arm 260 in association with a torsion spring 258 for biasing the ratchet arm 260. The ratchet arm 260 is shown engaging ratchet track 270, which is removably affixed to the housing 274. The ratchet track 270 is in association with a ratchet track holder 268, a shear pin 264, and screws 266.

Figure 5B:
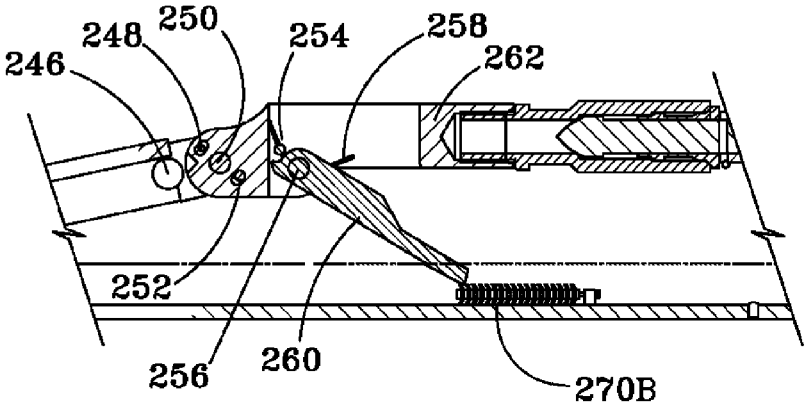

FIG. 5B illustrates a close up view of the central portion of another embodiment of the kickover tool 200. This embodiment is similar to that of FIG. 5A, in particular with respect to the ratchet arm 260 and the arm mechanisms discussed above and depicted in FIGS. 3B and 5A. This particular embodiment uses an arrangement of Bellville washers 270B to engage one end of the ratchet arm 260. When a motive force is applied to the kickover tool 200, the motive force causes the arrangement of Bellville washers 270B to compress, thus allowing the arm to move into a retracted position.

Figure 5C:
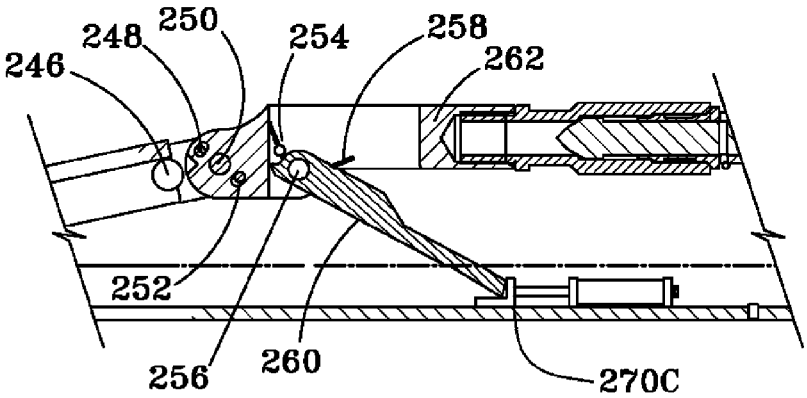

FIG. 5C illustrates a close up view of the central portion of yet another embodiment of the kickover tool 200. This embodiment is similar to that of FIGS. 3B, 5A, and 5B, except for the addition of actuating member 270C which allows for biasing of the ratchet arm 260, which actuating member 270C engages. This actuating member can use various known actuation methods including, but not limited to, hydraulic, pneumatic, and/or electric operation. When a motive force is applied to the kickover tool 200, the motive force causes the actuating member 270C to compress, thus allowing the arm to move into a retracted position. Further embodiments of the kickover tool depicted in FIG. 5C can allow for the remote operation of actuating member 270C for a controlled actuation for extending or retracting the arm of kickover tool 200.

Figure 6A:
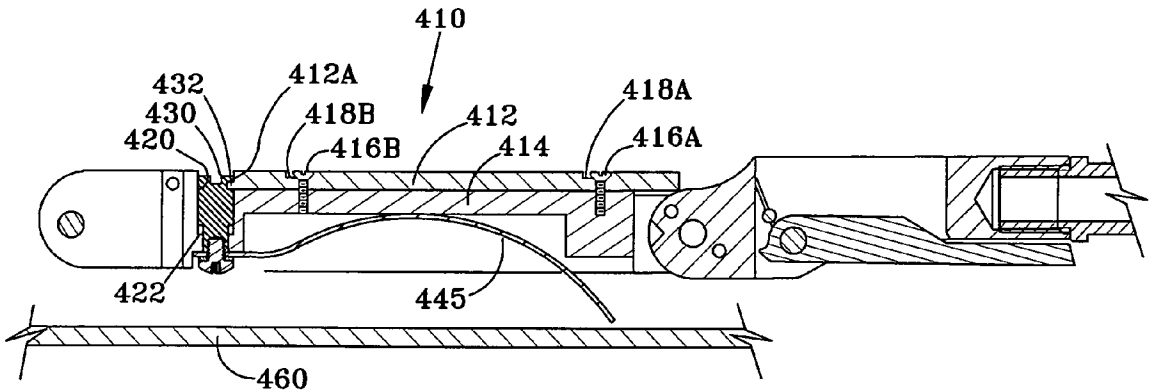
FIGS. 6A and 6B illustrate a cut-away detailed side view of an embodiment of a kickover tool in accordance with embodiments of the present disclosure.

FIG. 6A illustrates an embodiment of a kickover tool in accordance with the teachings of this disclosure. This embodiment includes a biasing spring 445, shown under load in FIG. 6A and with little or no tension in FIG. 6B, which is used to bias the pivot arm 410 away from housing 460. The biasing spring 445 is attached to pivot arm 410 by way of a fastener, such as a set screw; the fastener is connected to plug 430 formed within the cavity 420. The plug 430 has formed thereon a stay 432 for receiving catch 412A of the slide bar 412. Slide bar 412 is attached to the pivot arm 410 in a slidable engagement and includes slots 418A and 418B formed thereupon with fasteners 416A and 416B extending through said slots 418A and 418B for fastening to support 414 of the pivot arm 410. When the biasing spring 445 is under load the slide bar 412 and catch 412A are engaged with stay 432 of plug 430 thereby restricting movement of the second arm member.

Figure 6B:
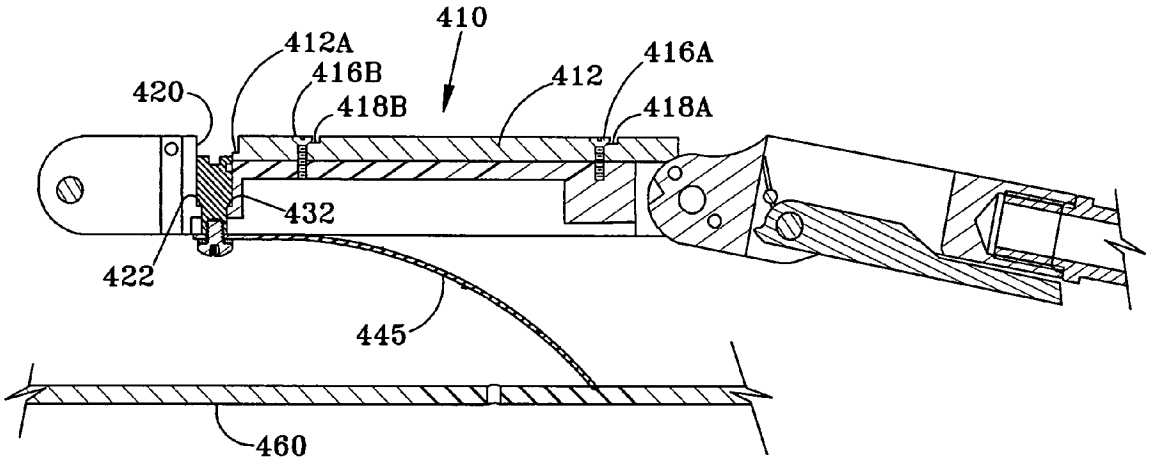

FIG. 6B depicts the embodiment of the kickover tool of FIG. 6A when the biasing spring 445 is under little or no load and the pivot arm 410 is in an extended position away from housing 460. When the biasing spring 445 is under little or no load the plug 430 and stay 432 disengage from the slide bar 412 and catch 412A which allows movement of the second arm member.

Figure 7:
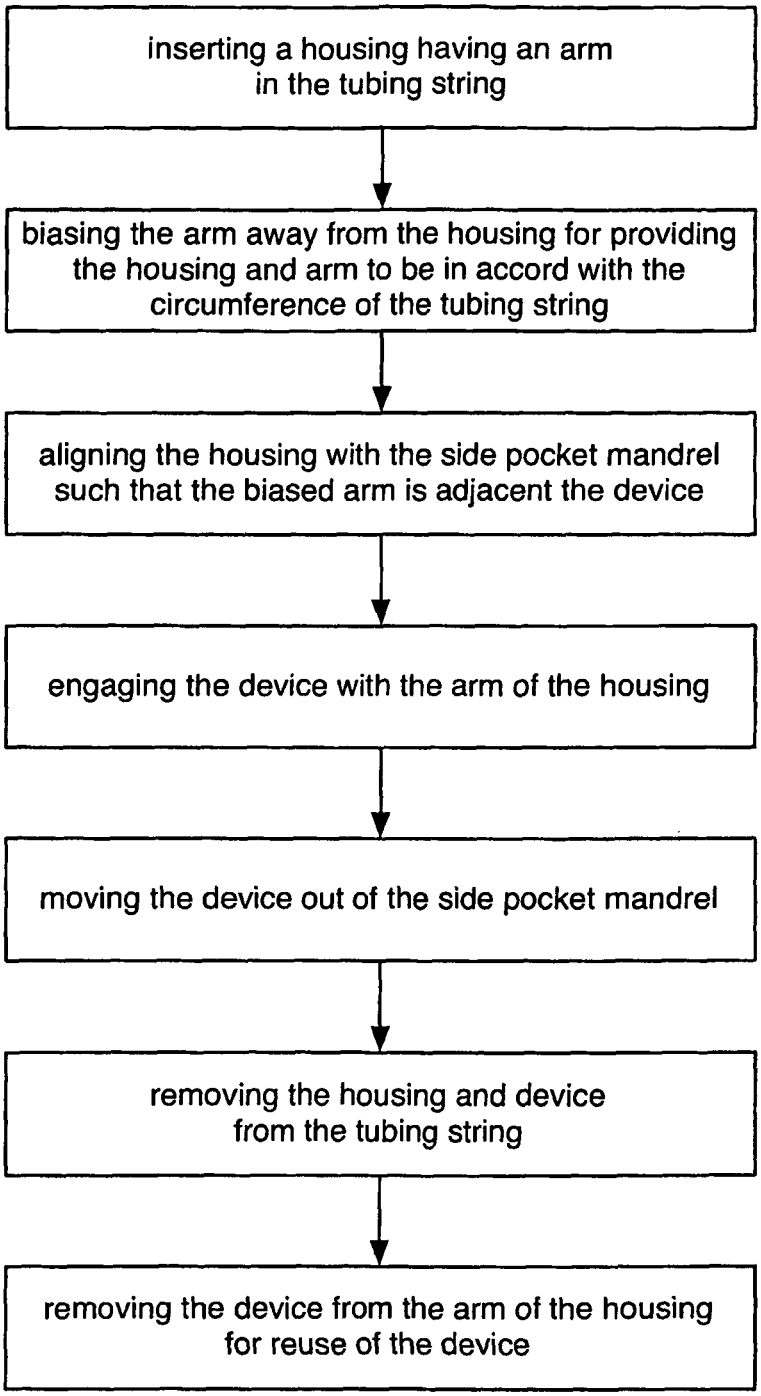
FIG. 7 is a flow chart illustrating a method of removing a device with respect to the present disclosure, including a series of method steps for using the kickover tool of the present disclosure.

FIG. 7 is a flow chart describing a method of removing an article with the kickover tool of the present disclosure. The removing method has multiple steps. A housing is inserted having an arm in the tubing string. The arm is biased away from the housing for providing the housing and arm to be in accord with the tubing string. The housing is aligned with the side pocket mandrel such that the biased arm is adjacent to the device. The device is engaged with the arm of the housing. The device is moved out of the side pocket mandrel. The housing is removed and the device is removed from the tubing string. And, the device is removed from the arm of the housing for reuse of the device. It can be appreciated by those skilled in the art that other appropriate methods of removing are equally applicable with respect to the present disclosure.

Figure 8:
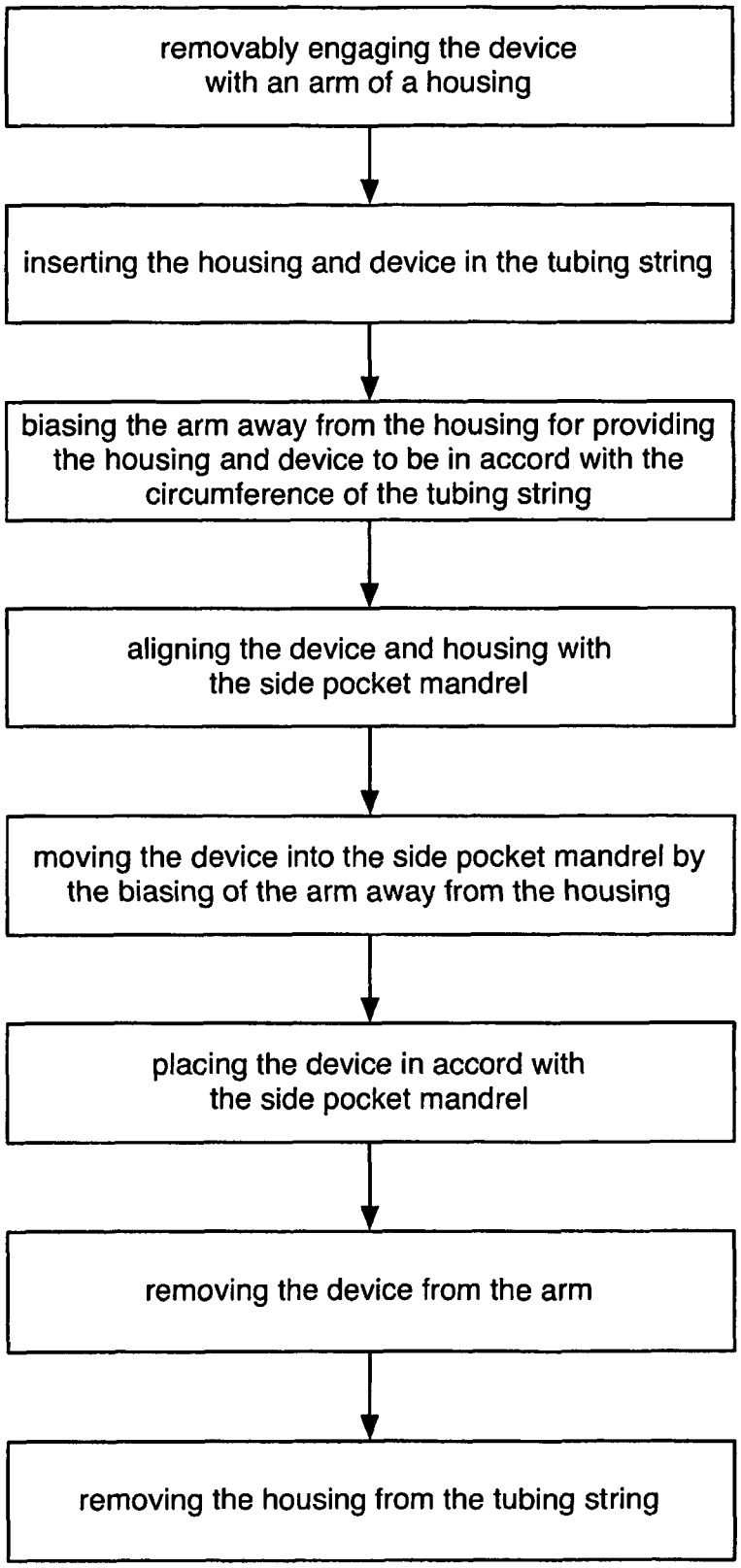
FIG. 8 is a flow chart illustrating a method of inserting a device with respect to the present disclosure, including a series of method steps for using the kickover tool of the present disclosure.

FIG. 8 illustrates a method of inserting. The method of inserting is described using multiple steps. The first step is removably engaging the device with an arm of the housing. The housing is inserted and the device is inserted in the tubing string. The arm is biased away from the housing for providing the housing and device to be in accord with the circumference of the tubing string. The device is aligned along with the housing with the side pocket mandrel. The device is moved into the side pocket mandrel by the biasing of the arm away from the housing. The device is placed in accord with the side pocket mandrel. The device is removed from the arm. And the housing is removed from the tubing string.

In conjunction with the disclosures of FIGS. 7 and 8, the present disclosure provides various methods of using the kickover tool as herein disclosed. The present disclosure also contemplates several methods of using the disclosed kickover tool apparatus, as follows. A first method that can be used with the kickover tool apparatus is a single kickover tool apparatus used to place or retrieve a tool or object from a side pocket mandrel within a tubing string. The kickover tool apparatus is first introduced into the tubing string via a wellbore. The kickover tool apparatus then traverses a predetermined distance within the tubing string at which a side pocket mandrel would be preferably situated. The kickover tool apparatus will usually be of an unknown orientation as it traverses the tubing string, so use of a collar is preferable so as to provide an orientation that will allow the arm assembly to extend and retract into the side pocket mandrel unimpeded. Once the kickover tool apparatus is situated in the appropriate orientation at the side pocket mandrel, the arm assembly is moved into an extended position substantially into the side pocket mandrel. The arm assembly can be extended through the use of a spring, such as a coil or leaf spring, or through an actuation device, such as pneumatics, hydraulics, or electricity. Once the arm begins to move into an extended position, the ratchet arm engages the plurality of teeth of the ratchet track thus locking the arm assembly into an extended position. The kickover tool apparatus then places or retrieves the tool or object from or into the side pocket mandrel. The kickover tool apparatus then has a motive forced exerted thereupon which causes the kickover tool apparatus to traverse the tubing string towards the wellbore. This motive force causes the arm assembly to substantially contact a portion of the wall of the side pocket mandrel, which then exerts a force against the arm assembly causing the arm assembly to move into a retracted position. In embodiments with the ratchet arm and ratchet track, the force exerted upon the arm assembly should be sufficient to cause the shear pin of the ratchet track to shear thus causing the ratchet track to move and thus allowing the arm assembly to collapse into a retracted position. Once the shear pin is sheared, the arm assembly returns to a retracted position and allows for the kickover tool apparatus to be retrieved from the well. If the kickover tool apparatus retrieved a tool or object, the object will traverse the tubing string with the kickover tool apparatus for retrieval once the kickover tool apparatus is removed from the tubing string through a wellbore. A method of using an embodiment of the kickover tool as disclosed herein may comprise the steps of: engaging, removably, the device with an arm of a housing, inserting the housing and device in the tubing string, biasing the arm away from the housing for providing the housing and device to be in accord with the circumference of the tubing string, aligning the device and housing with the side pocket mandrel, moving the device into the side pocket mandrel by the biasing of the arm away from the housing, placing the device in accord with the side pocket mandrel, removing the device from the arm, and removing the housing from the tubing string.

Another method of using an embodiment of the kickover tool as disclosed herein may comprise the steps of: inserting a housing having an arm in the tubing string, biasing the arm away from the housing for providing the housing and arm to be in accord with the circumference of the tubing string, aligning the housing with the side pocket mandrel such that the biased arm is adjacent the device, engaging the device with the arm of the housing, removing the device out of the side pocket mandrel, removing the housing and device from the tubing string, removing the device from the arm of the housing for reuse of the device.

Additional embodiments and further method steps include the use of two kickover tool apparatuses, as disclosed herein, to achieve a result of removing a tool or object from a single side pocket mandrel and placing another tool or object into the same side pocket mandrel. The method steps will be essentially the same except that with multiple kickover tool apparatuses the tubing string should preferably have multiple collars installed so as to orient the kickover tool apparatus into the appropriate position. Further, the tools should preferably be offset at an angle in relation to each other; this can be 0 degrees to 360 degrees. Preferably, the orientation of each kickover tool apparatus should be an offset of 20 degrees. With the appropriate equipment installed into the tubing string, the method begins the same way as methods involving a single kickover tool apparatus, wherein the kickover tool apparatuses are introduced into the tubing string via a wellbore and traverse the tubing string until a predetermined distance has been traveled. The string of kickover tool apparatuses is then moved to engage the first collar thus allowing the first kickover tool apparatus in a string to orient into the correct position for placement or retrieval of its payload in the single side pocket mandrel and occurs the same as using a single kickover tool apparatus. Once the first operation is completed, the string of kickover tool apparatuses is then caused to travel in the tubing string so as to engage the second collar that allows the second kickover tool apparatus to orient into the correct position for retrieval or placement of its payload in the single side pocket mandrel. Each time a placement and retrieval operation is completed a motive force is exerted upon the string of kickover tool apparatuses causing the arm assembly of the kickover tool apparatus that is in communication with the single side pocket mandrel to collapse into a retracted position, thus allowing the string of kickover tool apparatuses to continue traversing the tubing string.

The present disclosure further enables an apparatus and method of use for placing and/or retrieving a device from a multiple-pocket side pocket mandrel, i.e. one side pocket mandrel with more than one pocket; the number of pockets requires twice the number of kickover tools to service the mandrel.

The above method involving a string of multiple kickover tool apparatuses, as disclosed herein, can be further expanded to include multiple side pocket mandrels thus allowing multiple placement and retrieval operations to occur in a single trip through the tubing string. It should be appreciated that the placement of collars and individual kickover tool apparatuses can be varied as is appropriate and configured in an assortment of degrees so as to accommodate efficient communication with the side pocket mandrels. Additionally, this can be accomplished in side pocket mandrels with multiple side pockets as well, i.e. pulling a device from one pocket and placing another device into that pocket or pulling devices from multiple pockets (such as for example: corrosion coupons, fluid ID devices, fluid ID coupons) and replacing each with a predetermined selection. This method can also enable fluid identification metallurgy in a side pocket.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A kickover tool for installing and/or retrieving a well service device from a tubing string having a side pocket mandrel in a wellbore comprising:

a housing, an arm pivotally attached to the housing, the arm comprising a first arm member, a second arm member, and a receptor at an end of the second arm member for removably receiving the device, an elastic member for biasing the arm from the housing when the kickover tool is inserted in the tubing string, a latch comprising a ratchet arm engaged with the first arm member of the arm and a ratchet track engaged with the housing using a shear pin, such that the shear pin severs and the latch is released upon the application of a predetermined force, wherein the latch is adapted for securing the arm at a fixed position from the housing when the elastic member displaces the arm for positioning the device in the side pocket mandrel, such that, upon installation, the device is displaced from the arm of the kickover tool when the device is positioned in the side pocket mandrel, and upon retrieval, the device is secured to the arm of the kickover tool when the device is positioned in the side pocket mandrel.

2. The kickover tool of claim 1 wherein the housing comprises a first end, a second end, and a concaved portion disposed between the first end and the second end for receiving the arm and the device when the elastic member is compressed.

3. The kickover tool of claim 2 further comprising a fish neck engaged with the first end of the housing.

4. The kickover tool of claim 2 further comprising a nose member engaged with the second end of the housing.

5. The kickover tool of claim 1 wherein the elastic member comprises a spring.

6. The kickover tool of claim 5 wherein the spring is engaged between the housing and the first arm member of the arm.

7. The kickover tool of claim 1 further comprising a locator finger engaged with the housing for positioning the kickover tool relative to the side pocket mandrel.

8. A kickover tool comprising:

a body comprising a first end, a second end, and an intermediate section, the intermediate section comprising a convexed portion and a concaved portion;

an assembly comprising an arm pivotally attached to the first end of the body;

the assembly being movable between a retracted position substantially contained within the concaved portion of the body and an extended position with the assembly remote from the body;

a ratchet arm comprising a first end and a second end, the first end being pivotally attached to the assembly; and a ratchet track engaged with the concaved portion of the body with a fastener for selective engagement with the second end of the ratchet arm, the fastener allowing the ratchet track to disengage from the concaved portion upon the application of a predetermined amount of force.

9. The kickover tool of claim 8, wherein the fastener comprises a shear pin.

10. The kickover tool of claim 8, further comprising a spring having a first end and a second end, the first end of the spring in communication with the body and the second end of the spring attached to the assembly, the spring continuously biasing the assembly into the extended position.

11. The kickover tool of claim 10, wherein the spring is a leaf spring.

12. The kickover tool of claim 10, wherein the spring is a coil spring.

13. The kickover tool of claim 10, wherein the ratchet arm is pivotally attached to the assembly by a shear pin.

14. The kickover tool of claim 8, wherein the ratchet arm is pivotally attached to the assembly by a shear pin.

15. A kickover tool apparatus comprising:

a tubular body comprising a first end and a second end, a first surface having a generally cylindrical shape, and a second concaved surface, the first surface and the second concaved surface situated between the first end and the second end;

an assembly comprising an arm having a first section and a second section, each section having a first end and a second end, the first end of the first section being pivotally attached proximate to the first end of the tubular body, the second section being pivotally attached to the second end of the first section, the assembly being movable between a retracted position substantially contained within the second concaved surface of the tubular body and an extended position remote from the second concaved surface of the tubular body;

a ratchet arm comprising a first end and a second end, the first end of the ratchet arm being pivotally attached to the second section of the assembly; and a ratchet track attached on the second concaved surface of the tubular body for selective engagement with the second end of the ratchet arm.

16. The kickover tool apparatus of claim 15, wherein the ratchet track is attached on the second concaved surface of the tubular body with a fastener that will allow the ratchet track to move upon engagement with a predetermined force.

17. The kickover tool apparatus of claim 15, further comprising a spring having a first end and a second end wherein the first end of the spring is attached to the second concaved surface of the tubular body, and the second end of the spring is attached to the assembly, the spring continuously biasing the assembly into the extended position.

18. A system for installing into and/or retrieving from a tubing string a plurality of well service devices, the tubing string engaged in a wellbore and having a side pocket mandrel, the system comprising:

a plurality of kickover tools, each kickover tool comprising a housing, a pivoting arm, and a ratchet arm, said housing comprising a cylindrical portion, a concaved portion, and a locator finger, said pivoting arm comprising an engagement member, wherein the pivoting arm is engaged with the cylindrical portion of the housing, wherein the concaved portion of the housing is engaged, by means of a shearable fastener, with a ratchet track for selective engagement with the ratchet arm, wherein the engagement member is configured to receive one of the plurality of well service devices; and wherein the plurality of kickover tools are arranged for insertion into the tubing string such that the respective locator fingers are disposed at different angles for engagement with at least one receptive locator slot, such that a plurality of kickover tools can be deployed together in a single downhole run for engagement with a plurality of side pockets, and wherein the respective concaved portions of the housing receive the respective pivoting arms and well service devices, wherein said respective pivoting arms are biased away from said respective concaved portions of the housing, and wherein the shearable fastener allows the ratchet track to disengage from the concaved portion of the housing upon the application of a predetermined amount of force.

* * * * *